United States Patent [19]

Ross

[11] Patent Number: 4,650,182

[45] Date of Patent: Mar. 17, 1987

[54] JAW EXERCISE DEVICE

[76] Inventor: John H. Ross, 1254 66th St. N., St. Petersburg, Fla. 33710

[21] Appl. No.: 596,691

[22] Filed: Apr. 4, 1984

[51] Int. Cl.[4] ..... A63B 23/00

[52] U.S. Cl. ..... 272/95; 128/89 A; 433/5

[58] Field of Search ..... 128/89 A, 97, 136, 137; 272/94, 95, 126, 135, 139, 142; 433/5

[56] References Cited

U.S. PATENT DOCUMENTS

| | | | |
|---|---|---|---|
| 523,192 | 7/1894 | Angle | 433/5 |
| 862,881 | 8/1907 | Case | 433/5 |
| 1,587,558 | 6/1926 | Sheffield | 128/89 A |
| 1,992,904 | 2/1935 | Preston | 128/89 A |
| 2,453,934 | 11/1948 | Preston | 128/97 X |
| 2,467,943 | 4/1949 | Mikell, Jr. | 272/139 X |
| 3,571,930 | 3/1971 | Woskin | 433/5 |

*Primary Examiner*—Richard J. Apley

*Assistant Examiner*—S. R. Crow

*Attorney, Agent, or Firm*—Arthur W. Fisher, III

[57] ABSTRACT

A method of exercise utilizing a jaw exercise device specifically configured to exercise the muscles of mastication and their auxiliaries comprising an upper head band having two pair of fastening members extending outwardly from the side surface thereof, a chin strap having an attachment member attached to opposite ends thereof and a pair of elastic coupling members to interconnect the two pair of fastening members to the corresponding attachment members such that the upper head band is secured to the upper portion of the user's head and the chin strap is placed on the user's chin whereby each attachment member is coupled to the corresponding fastening member to attach the chin strap to the head band securing the jaw exercise device to the user's head and jaw whereby the user exercises the muscles of mastication and their auxiliaries by repetitively opening and closing his/her jaw.

1 Claim, 3 Drawing Figures

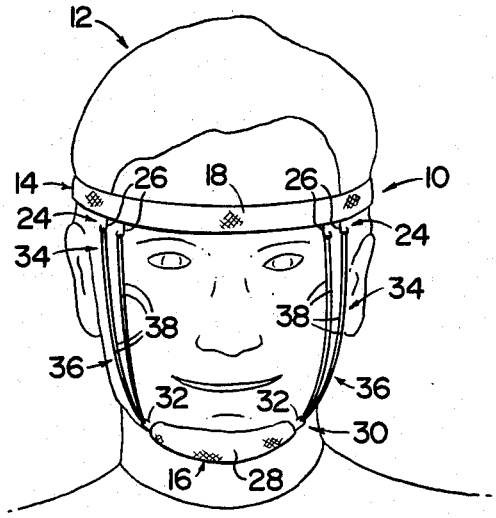
FIG. 1
FIG. 2
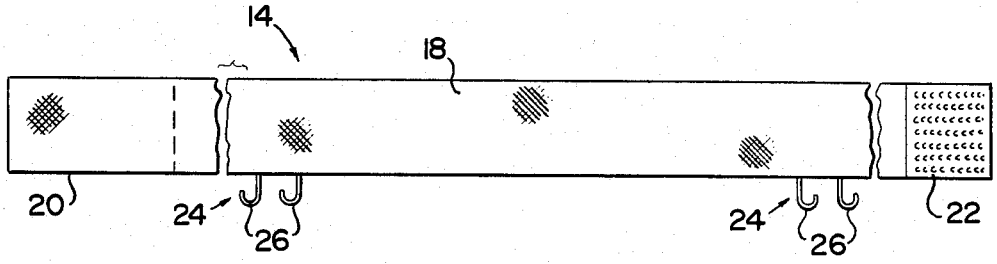
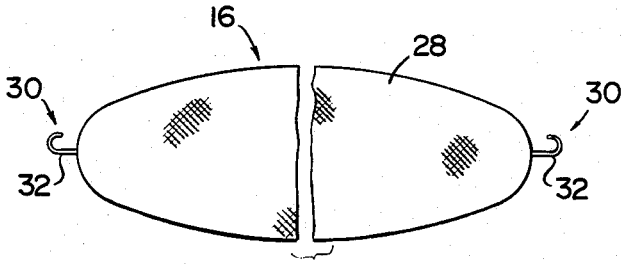
FIG. 3

JAW EXERCISE DEVICE

BACKGROUND OF THE INVENTION

1. Field of the Invention

A method of exercise utilizing a jaw exercise device specifically configured to exercise the muscles of mastication including the temporal, masseter, external pterygoid and internal pterygoid and their auxiliaries. The primary purpose of the jaw exercise device is to supplement theraputic modality for relief of temporomandibular joint and/or myo-facial pain symptoms. Through the use of this jaw exercise device the patient is motivated to a self-help program and thereby reduce the likelihood or avoid extensive surgical procedures and their attendant hospital stays and recuperative periods.

The temporomandibular area, located in front of each ear and various temporomandibular dysfunctions are commonly referred to as TMJ.

The temporomandibular joint serves as a hinge for the lower jaw. The TM joint may become misaligned because of aging, arthritis, a blow to the jaw or head or yawning for prolonged periods with the mouth open too wide. Among the more common temporomandibular joint dysfunction symptoms are:

earaches, tinnitus (ringing, tinkling, hissing), clicking, (Articular Crepitus), difficulty in opening the mouth (Trismus), headaches (particularly in the infratemporal region) and vertigo.

Dentists often concentrate on reducing painful muscle spasms through heat, massage, and drugs that relax the muscles and kill pain which may temporarily reduce these symptoms.

Treatment may also include use of a bite plate, which is an individually fitted acrylic mouthpiece that slips on the lower or upper teeth to reposition the jaw or redistribute stress.

More complex treatment may be directed to correcting malocclusion by causing the upper and lower jaws to mesh again. Occlusal restoration involves restoring bad teeth and replacing missing ones. This is often sufficient to relieve the pain and discomfort of mild TM dysfunctions. More involved TM dysfunctions may require equilibration or balancing the jaws by grinding away high spots and fill in low spots on the teeth, allowing the jaw muscles to relax.

Another technique comprises relaxation training assisted by biofeed back that frequently yields the greatest results in relieving facial pain stemming from nighttime tooth grinding.

Various efforts have been made to strengthen or improve neck, facial or oral muscles through exercise. Generally, these comprise means of compression and not as described and disclosed more fully hereinafter. The following U.S. Patents show various means for exercising specific head, oral or facial muscles: U.S. Pat. Nos. 1,953,088; 3,497,217; 3,547,217; 3,721,439; 3,736,925; 3,813,096 and 4,195,833.

SUMMARY OF THE INVENTION

The present invention relates to a method of exercise utilizing a jaw exercise device specifically configured to exercise the muscles of mastication and their auxiliaries including an upper head band and a lower chin strap.

The upper head band comprises an elongated flexible strip having securing means formed on opposite ends thereof. Disposed on opposite sides of the elongated flexible strip is a fastening means each comprising a pair of fastening members. Each fastening member comprises a hook or J shaped element affixed to the elongated flexible strip extending outwardly and downwardly from the upper head band.

The lower chin strap comprises a chin retaining member configured to support and receive the user's chin thereon. Extending from opposite sides or ends of the chin support is a substantially J shaped hook or attachment means. A coupling means comprising a pair of elastic resistance coupling members is provided to couple or interconnect the upper head band and lower chin strap.

In use, the upper head band is attached to the upper portion of the user's head above the ears by means of the securing means. The lower chin strap is then positioned on the user's chin attaching each elastic resistance coupling members between the fastening members and the attachment means to attach the entire jaw exercise device to the user's head.

Once in position, the user exercises or uses the jaw exercise device by consciously moving or opehing his/her jaw against the elastic resistance force of the elastic resistance coupling members. By repetitive exercise and use, the user or patient may strengthen the muscles of mastication and auxiliaries.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a front view of the jaw exercise device in place.

FIG. 2 is a detailed view of the upper head band.

FIG. 3 is a detailed view of the lower chinstrap.

Similar reference characters refer to similar parts throughout the several views of the drawings.

DETAILED DESCRIPTION OF THE PREFERRED EMBODIMENT

As shown in FIGS. 1 through 3, the present invention relates to a jaw exercise device generally indicated as 10. As more fully described hereinafter, the jaw exercise device 10 is specifically configured for mounting on the head of the person generally indicated as 12 to exercise the muscles of mastication and auxiliaries thereof. The jaw exercise device 10 comprises an upper head band and a lower chin strap generally indicated as 14 and 16 respectively.

As shown in FIG. 2, the upper head band 14 comprises an elongated flexible strip 18 having a corresponding pair of velcro fasteners indicated as 20 and 22 or similar securing means formed on opposite ends thereof. Disposed on opposite sides of the elongated flexible strip 18 is a pair of fastening means, each pair generally indicated as 24. Each fastening means 24 comprises at least two fastening members of hooks, J shaped elements 26 affixed to the elongated flexible strip or bahd 18 and extending outwardly and downwardly from the upper head band 14.

As shown in FIG. 3, the lower chin strap 16 comprises a chin retaining member 28 configured to support and receive the user's chin thereon. Extending from opposite sides or ends of the chin support 28 is an attachment means or attachment member each indicated as 30. Each attachment member 30 comprises a hook or J shaped element 32.

As shown in FIG. 1, the jaw exercise device 10 further includes a pair of coupling means each generally indicated as 34 to selectively interconnect opposite ends of the lower chin strap 16 to the upper head band 14 by coupling each attachment means 30 to the corresponding fastening means 24. Each coupling means 34 comprises a plurality of elastic members 36 to selectively interconnect hooks 26 to corresponding hooks 32 to cooperatively form a substantially V-shaped configuration on opposite sides of the user's head 12. Each elastic member 36 may comprise a plurality of elastic elements each indicated as 38.

In use, the upper head band 14 is attached to the upper portion of the user's head 12 above the ears by means of the velcro fasteners 20 and 22 or similar fastening means. The lower chin strap 16 is then positioned on the user's chin attaching fastening means 24 to corresponding attachment means 30 to attach the entire jaw exercise device 10 to the user's head.

Once in position, the user exercises or uses the jaw exercise device 10 by consciously moving or opening his/her jaw against the elastic or resistance force of the elastic members 36. Resistance may be varied by increasing or decreasing the number of elastic elements 38 of each elastic member 36. By repetitive exercise and ue, the user or patient strengthens the muscles of mastication and the auxiliaries thereof.

It will thus be seen that the objects set forth above, and those made apparent from the preceding description are efficiently attained and since certain changes may be made in the invention, it is intended that all matter contained in the above description or shown in the accompanying drawings shall be interpreted as illustrative and not in a limiting sense.

It is also to be understood that the following claims are intended to cover all of the generic and specific features of the invention which as a matter of language, might be said to fall therebetween.

Now that the invention has been described, what is claimed is:

1. A method of exercising the temporo-mandibular joint to strengthen the muscles of mastication and auxiliaries thereof comprising:

(a) securing a horizontally disposed upper head band including an elongated flexible strip having fastening means formed on opposite ends thereof to selectively engage each other to secure the horizontally disposed upper head band to the upper portion of the user's head at the temple/forehead region;

(b) positioning a chin strap having attachment means formed on opposite ends thereof on the user's lower jaw in the chin region;

(c) interconnecting said horizontally disposed upper head band to said chin strap by means of two pair of elongated elastic members coupled between two pair of fastening members formed on said horizontally disposed upper head band and said attachment means;

(d) one of said elongated elastic members of each said pair of elongated elastic members being vertically disposed, the other of said elongated elastic members of each said pair of elongated elastic members being inclined relative to said corresponding vertically disposed elongated elastic member;

(e) whereby the user exercised the muscles of mastication by repetitively opening and closing his/her lower jaw such that each of said pair of elongated elastic members is disposed substantially parallel to the muscles of mastication and auxiliaries on opposite sides of the user's jaws.

* * * * *